US007249799B2

(12) United States Patent
Luce

(10) Patent No.: US 7,249,799 B2
(45) Date of Patent: Jul. 31, 2007

(54) LOUNGE CADDY

(76) Inventor: Brian Luce, 230 Winchester Ave., Glendale, CA (US) 91201

( * ) Notice: Subject to any disclaimer, the term of this patent is extended or adjusted under 35 U.S.C. 154(b) by 0 days.

(21) Appl. No.: 11/185,051

(22) Filed: Jul. 20, 2005

(65) Prior Publication Data

US 2006/0082197 A1 Apr. 20, 2006

Related U.S. Application Data

(60) Provisional application No. 60/619,467, filed on Oct. 15, 2004.

(51) Int. Cl.
*A47C 7/62* (2006.01)

(52) U.S. Cl. ..... 297/188.18; 297/188.13; 220/751

(58) Field of Classification Search ..... 297/188.06, 297/188.07, 188.18, 188.19, 188.2, 188.13; 224/275; 150/119; 220/521, 751
See application file for complete search history.

(56) References Cited

U.S. PATENT DOCUMENTS 2,672,988 A * 3/1954 Johnson ..... 211/88.01
2,979,120 A * 4/1961 Amburn ..... 297/188.2
3,042,467 A * 7/1962 Germick ..... 297/188.18
3,078,478 A * 2/1963 Sheahan ..... 108/49
3,986,649 A * 10/1976 Heimstra ..... 211/42
4,339,061 A * 7/1982 Dunn ..... 297/188.18
4,556,250 A 12/1985 Chapman et al.
4,799,731 A 1/1989 Brown
4,917,160 A * 4/1990 Hart et al. ..... 224/675
5,180,067 A * 1/1993 Conaway et al. ..... 211/119
5,255,401 A * 10/1993 Sambrookes et al. ..... 211/112
5,350,215 A * 9/1994 DeMars ..... 297/188.14
5,356,061 A * 10/1994 Yu ..... 297/188.06
5,382,074 A * 1/1995 Pietra ..... 297/153
5,503,297 A * 4/1996 Frankel ..... 220/751
5,526,907 A 6/1996 Trawick et al.
D383,302 S * 9/1997 Broussard ..... D3/201
D392,613 S * 3/1998 Peters ..... D12/416
6,036,262 A 3/2000 Shahid
6,042,180 A 3/2000 Lombardi
6,290,063 B1 * 9/2001 Vogt et al. ..... 220/574
6,336,413 B1 * 1/2002 Ball ..... 108/44
6,520,351 B1 * 2/2003 Zadro ..... 211/119
6,682,118 B2 * 1/2004 Ryan ..... 296/39.1

* cited by examiner

*Primary Examiner*—Peter R. Brown
(74) *Attorney, Agent, or Firm*—James Ray & Assoc.

(57) ABSTRACT

A storage apparatus for use in an outdoor environment such as a swimming pool and a beach. Such storage apparatus comprises a holder having a predetermined shape and formed from a predetermined material, such holder having a plurality of compartments disposed therein, and a means engageable with the holder for securing the storage apparatus to one of a chaise lounge, a beach chair, other outdoor chairs and boat rails.

17 Claims, 4 Drawing Sheets

LOUNGE CADDY

CROSS REFERENCE TO RELATED APPLICATIONS

This application is closely related to and claims benefit from U.S. Provisional Application Ser. No. 60/619,467 filed Oct. 15, 2004.

FIELD OF THE INVENTION

The present invention relates in general to a storage means, and more specifically, the present invention relates to an easily accessible storage area for personal items for use outdoors that can attach to a chair arm, chair frame or boat rails.

BACKGROUND OF THE INVENTION

When people are outdoors such as camping or going to the beach they often leave personal items, such as a wallet, magazine, book or such items out in the open where the item(s) can end up on the ground or left exposed to the elements.

Rather than leave such personal items exposed on the ground where they could easily get wet it would be desirable if there were a storage means that a person could use to store these personal items and keep them off of the ground. It also is desirable if some of these personal items can be kept out of sight.

SUMMARY OF THE INVENTION

The present invention provides a storage apparatus for use in an outdoor environment such as a swimming pool and a beach. Such storage apparatus comprises a holder having a predetermined shape and formed from a predetermined material, such holder having a plurality of compartments disposed therein, and a means engageable with the holder for securing the storage apparatus to one of a chaise lounge, a beach chair and other outdoor chairs.

OBJECTS OF THE INVENTION

It is, therefore, one of the primary objects of the present invention to provide an apparatus for use in storage of personal items in an outdoor environment.

Another object of the present invention is to provide an apparatus for use in storage of personal items that can be attached to the arm of a chaise lounge, a beach chair or boat rails.

Still another object of the present invention is to provide an apparatus for use in storage of personal items that can also hold a beverage container.

Yet another object of the present invention is to provide an apparatus for use in storage of personal items that is made of UV-protected polypropylene.

These and various other objects and advantages of this invention will become apparent after a full reading of the following detailed description, particularly, when read in conjunction with the attached drawings as described below and the appended claims.

Figure 1:
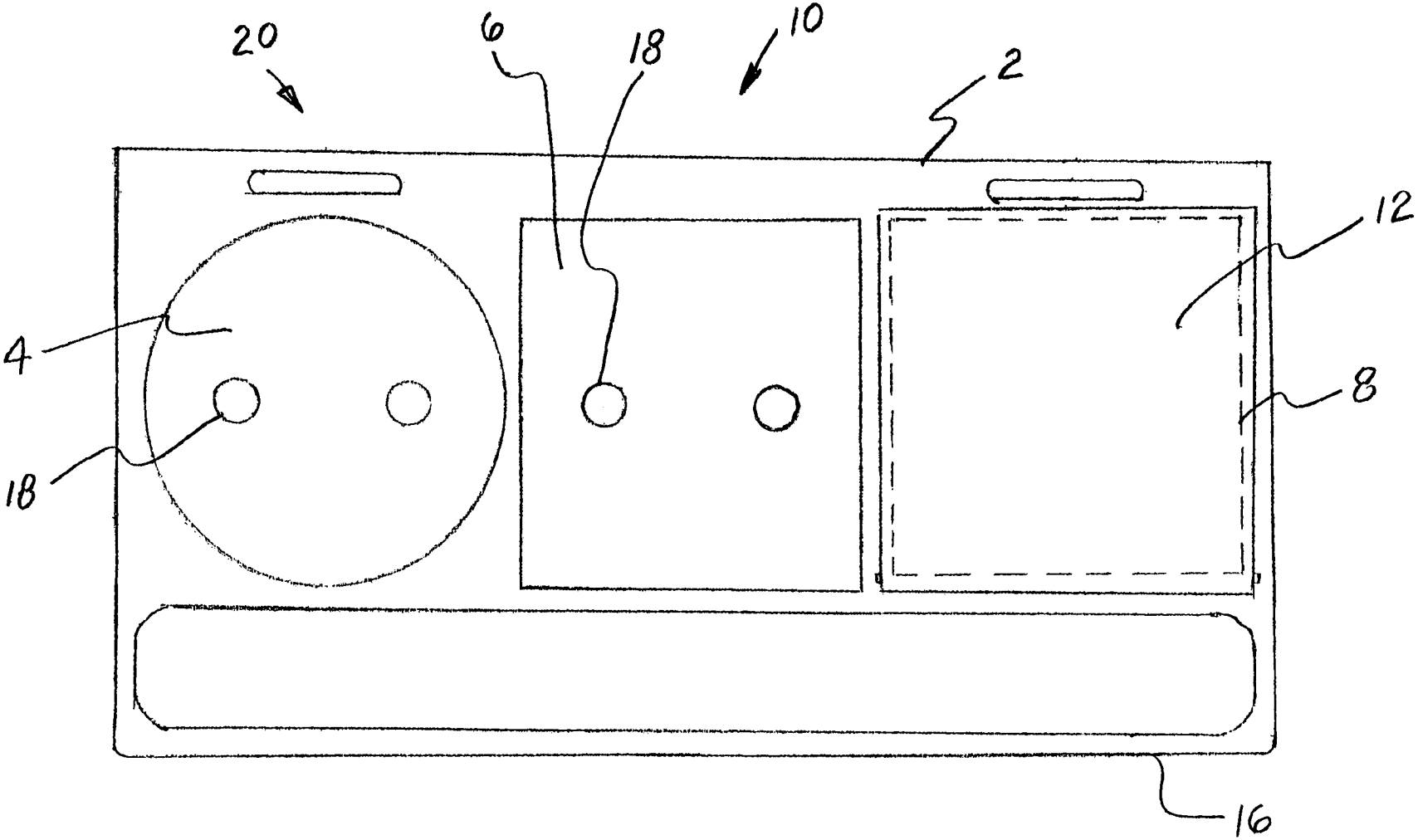
FIG. 1 is a top view of the storage apparatus according to an embodiment of the invention.

BRIEF DESCRIPTION OF THE PRESENTLY PREFERRED AND ALTERNATE EMBODIMENTS OF THE INVENTION

Prior to proceeding with the more detailed description of the present invention it should be noted that, for the sake of clarity, identical components which have identical functions have been designated by identical reference numerals throughout the several views illustrated in the drawings.

Figure 2:
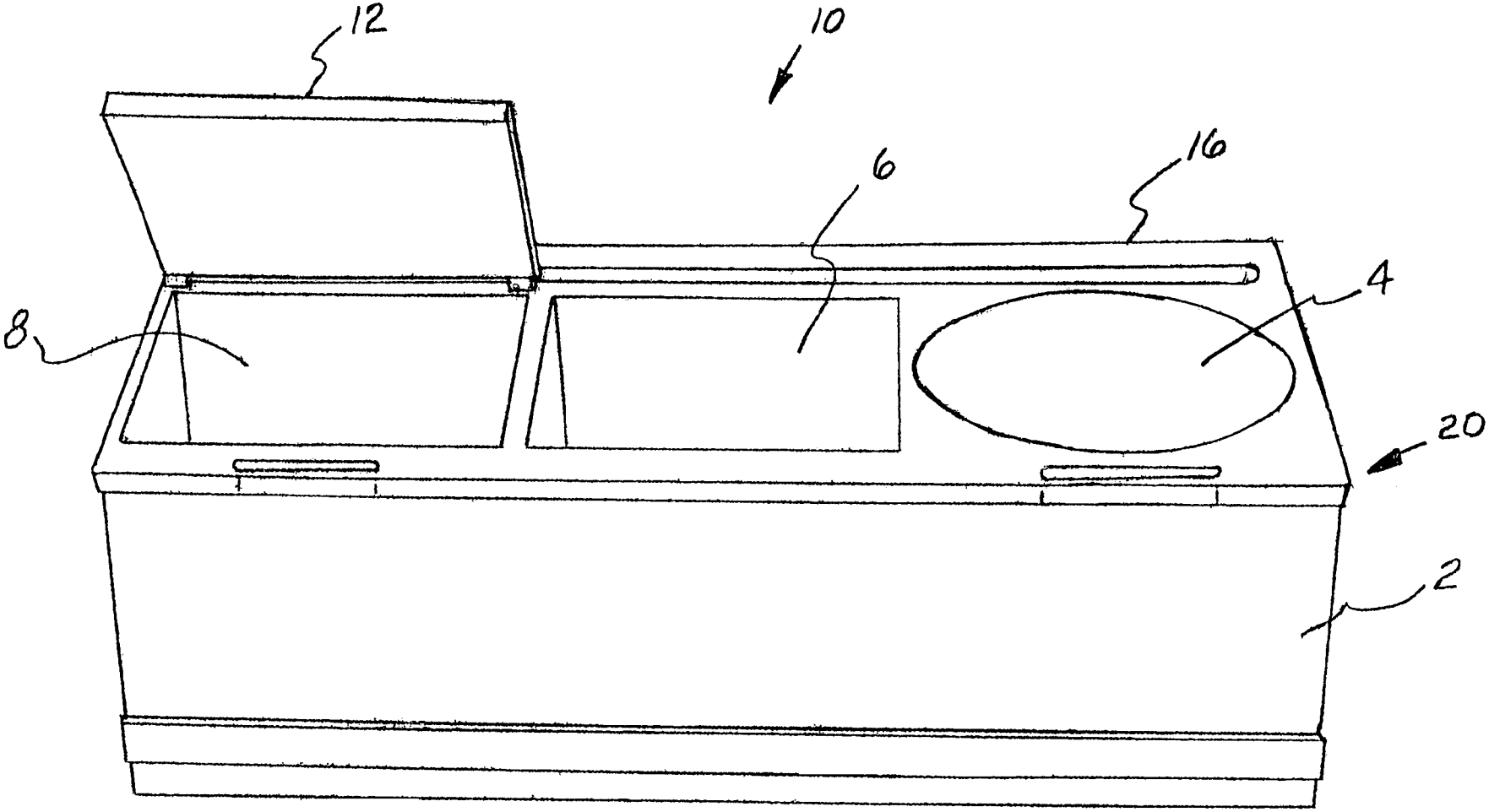
FIG. 2 is a partial perspective view of the back of the storage apparatus shown in FIG. 1. drawing of a FIG. 3 is a partial perspective view of the storage apparatus shown in FIG. 1 attached to the arm of a beach chair.
Figure 3:
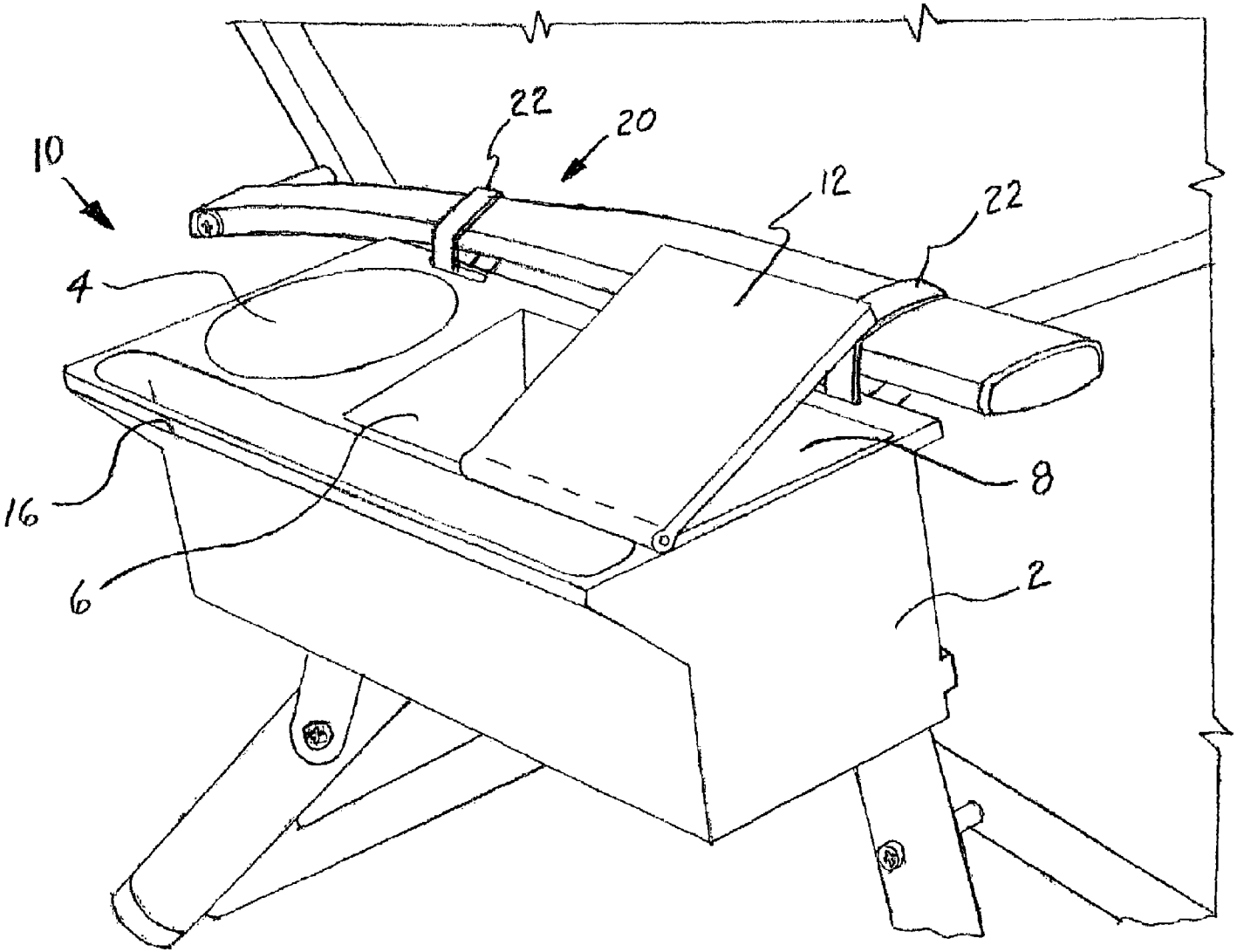

As is evident in FIGS. 1-3, the present invention provides a storage apparatus, generally designated 10, for use in an outdoor environment such as a swimming pool and a beach. Such storage apparatus 10 comprises a holder 2 having a predetermined shape and formed from a predetermined material.

Such holder 2 having a plurality of compartments disposed therein. In a presently preferred embodiment of the invention such plurality of compartments is three. A first compartment 4 is designed to retain a beverage container such as a can of soda pop, cup of coffee or any similar beverage container. A second compartment 6 is an open storage area for holding such items sun tan lotion, toiletries or other similar items. The third compartment 8 is a closed compartment for storage of such items as a wallet, keys or other personal items for which it is are desired that they not be visible. In a presently preferred embodiment of the invention such a closed compartment 8 is closed by means of a lid 12. It is also preferred that there are holes 18 in the bottom of the storage apparatus 10 beneath the compartments for drainage.

Such storage apparatus also includes a means, generally designated 20, that is engageable with the storage holder 10 for securing the storage apparatus 10 to one of a chaise lounge, a beach chair, other outdoor chairs and boat rails. Such means 20 may include snaps, hooks, ties, clips and straps. It is presently preferred that storage apparatus 10 be secured to such furniture by means of straps 22. It is further preferred that such straps 22 be made of Velcro (hook and loop material) or at least include hook and loop material on the strap 22. Such storage apparatus 10 also includes a pair of slots 24 closely adjacent an upper surface thereof for use with such securing means 20. Such storage apparatus 10 when it is secured to the arm of a beach chair or other furniture is further supported by the frame of the chair.

Such storage apparatus 10 can be formed of various materials such as vinyl, plastic, metal, cloth, canvas or various combinations thereof. In a presently preferred embodiment of the invention such holder 2 is formed of polypropylene. It is further preferred that such polypropylene be UV-protected polypropylene since the holder 2 is primarily designed for outdoor use.

Figure 4:
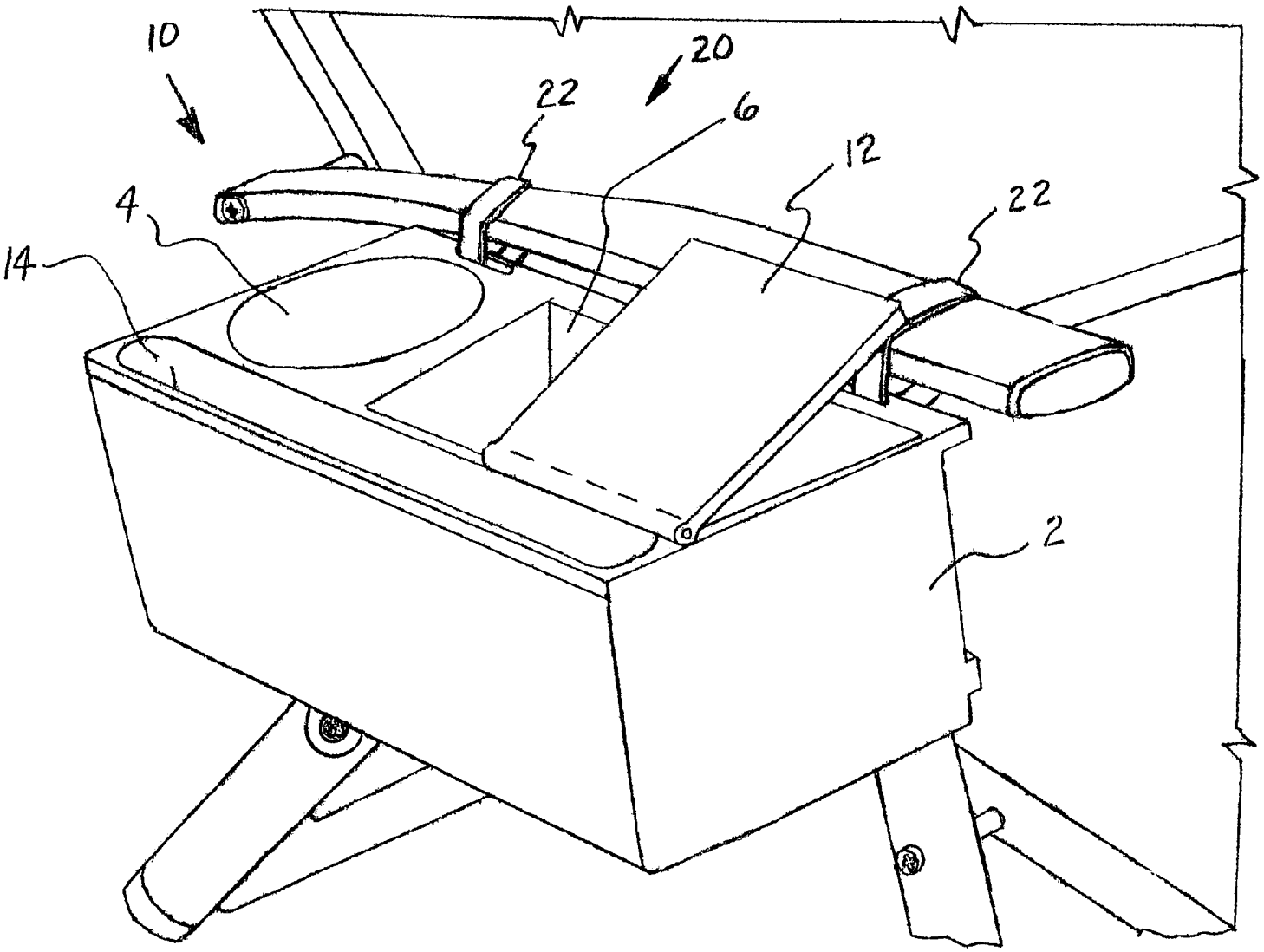
FIG. 4 is a partial perspective view of the storage apparatus according to an alternate embodiment of the invention.

It is also an embodiment of the invention that such holder 2 also have a pocket 14 or a bar 16 formed as part of the holder 2 for retaining such items as newspapers, magazines or books. It is preferred that such a bar 16 be used for holding these items. Illustrated in FIG. 4 is the storage apparatus 10 with the pocket 14 formed therein. As is clearly evident from FIG. 4 such pocket 14 is disposed vertically in the holder 2.

In an alternate embodiment of the invention which is referred to as an—at home—model, the storage apparatus has only two compartments 4, 6 for beverages and general storage with the closed compartment eliminated. Since this model is to be used at home there is no need for a closed compartment for wallets or keys.

It is also an embodiment of the invention that such storage apparatus can be made of various colors and that the front portion (facing away from the chair) may also feature a logo or other form of personalization via decals, stencils or other materials.

While both the presently preferred and a number of alternative embodiments of the present invention have been described in detail above it should be understood that various other adaptations and modifications of the present invention can be envisioned by those persons who are skilled in the relevant art without departing from either the spirit of the invention or the scope of the appended claims.

I claim:

1. A storage apparatus for use in an outdoor environment, said storage apparatus comprising:

(a) a holder having a predetermined shape including a top wall, bottom wall and four side walls, and formed from a predetermined material, said holder having a plurality of compartments disposed therein;

(b) a means engageable with said holder for securing said apparatus to one of an arm of a chaise lounge, a beach chair, other outdoor chairs and to boat rails. and (c) a single horizontally disposed bar formed integrally with said holder and extending outwardly from and coplanar with said top wall for retaining at least one of a newspaper, a magazine and a book.

2. The storage apparatus, according to claim 1, wherein said predetermined material for forming said holder is selected from a group including vinyl, plastic, canvas and combinations thereof.

3. The storage apparatus, according to claim 2, wherein said predetermined material for forming said holder is plastic.

4. The storage apparatus, according to claim 3, wherein said plastic is polypropylene.

5. The storage apparatus, according to claim 4, wherein said polypropylene is UV-protected polypropylene.

6. The storage apparatus, according to claim 1, wherein said predetermined shape is substantially rectangular.

7. The storage apparatus, according to claim 1, wherein said plurality of compartments is three.

8. The storage apparatus, according to claim 1, wherein at least one of said plurality of compartments includes a closure means.

9. The storage apparatus, according to claim 8, wherein said closure means is a lid.

10. The storage apparatus, according to claim 9, wherein said lid is hingedly attached.

11. The storage apparatus, according to claim 1, wherein one of said plurality of compartments is formed for retaining a beverage container.

12. The storage apparatus, according to claim 1, wherein said means for securing said holder to one of such chaise lounge, beach chair, other outdoor chairs and boat rails includes snaps, hooks, ties, clips and straps.

13. The storage apparatus, according to claim 12, wherein said means for securing said holder to one of such chaise lounge, beach chair and other outdoor chairs is straps.

14. The storage apparatus, according to claim 13, wherein said straps include hook and loop material.

15. The storage apparatus, according to claim 1, wherein said means for securing said holder to one of a chaise lounge, beach chair, other outdoor chairs and boat rails includes a pair of slots disposed on an upper surface of said storage apparatus.

16. The storage apparatus, according to claim 1, wherein said plurality of compartments is two.

17. The storage apparatus, according to claim 1, wherein said holder further includes holes on said bottom wall of said compartments for drainage.

* * * * *